US010473319B2

(12) United States Patent
Lin et al.

(10) Patent No.: US 10,473,319 B2
(45) Date of Patent: Nov. 12, 2019

(54) LIGHTING DEVICE, LED MODULE FOR A LIGHTING DEVICE, AND METHOD FOR ASSEMBLING A LIGHTING DEVICE

(71) Applicant: LEDVANCE GmbH, Garching bei Munchen (DE)

(72) Inventors: Ran Lin, Shenzhen Guangdong (CN); Jun Liu, Shenzhen Guangdong (CN); Shijun Nie, Shenzhen Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 15/837,548

(22) Filed: Dec. 11, 2017

(65) Prior Publication Data

US 2018/0187878 A1 Jul. 5, 2018

(30) Foreign Application Priority Data

Dec. 30, 2016 (CN) ..... 2016 1 1255246

(51) Int. Cl.

| | |
|---|---|
| ***F21V 31/00*** | (2006.01) |
| ***F21V 23/00*** | (2015.01) |
| ***F21V 29/70*** | (2015.01) |
| ***F21V 19/00*** | (2006.01) |
| *F21Y 115/10* | (2016.01) |

(52) U.S. Cl.

CPC ..... *F21V 31/005* (2013.01); *F21V 19/0025* (2013.01); *F21V 23/001* (2013.01); *F21V 23/003* (2013.01); *F21V 29/70* (2015.01); *F21Y 2115/10* (2016.08)

(58) Field of Classification Search

CPC ..... F21V 31/005
USPC ..... 362/249.02, 221, 234, 235
See application file for complete search history.

(56) References Cited

U.S. PATENT DOCUMENTS

| | | | | |
|---|---|---|---|---|
| 8,534,867 | B1 * | 9/2013 | Beadle | F21V 17/002 362/153.1 |
| 2013/0045457 | A1 * | 2/2013 | Chetiar | A61N 5/0601 433/29 |
| 2015/0319828 | A1 * | 11/2015 | Moon | H05B 33/0803 315/158 |
| 2016/0169454 | A1 * | 6/2016 | Moon | F21K 9/232 362/221 |
| 2017/0227209 | A1 * | 8/2017 | Slabek | F21V 31/005 |
| 2017/0256693 | A1 * | 9/2017 | Yoshizawa | F21V 29/74 |

* cited by examiner

*Primary Examiner* — Allyson N Trail
(74) *Attorney, Agent, or Firm* — Hayes Soloway PC

(57) ABSTRACT

A lighting device is provided, comprising at least one LED module, which is connected to a retainer, and a driver that is electrically connected to the LED module, wherein the driver is at least partially cast by a potting material wherein the driver is connected to the retainer via an adaptor board that is positioned in between the driver and the retainer.

20 Claims, 9 Drawing Sheets

LIGHTING DEVICE, LED MODULE FOR A LIGHTING DEVICE, AND METHOD FOR ASSEMBLING A LIGHTING DEVICE

CROSS-REFERENCE TO RELATED APPLICATIONS AND PRIORITY

This patent application claims priority from Chinese Patent Application No. 201611255246.9 filed on Dec. 30, 2016. This patent application is herein incorporated by reference in its entirety.

TECHNICAL FIELD

The present invention relates to a lighting device, an LED module for a lighting device, and a method for assembling a lighting device.

BACKGROUND

Lighting devices that are intended for use in wet and/or dusty environments, such as lighting devices for bathrooms or for outdoor illumination, require a protection against environmental influences and preferably satisfy IP code IP 65. Currently available lighting devices do not reliably fulfill the requirements for the mentioned applications and/or are too expensive because of a complex assembling process that is not automated. However, in order to avoid breakage of the lighting device due to penetration of water and/or dust, a reliable sealing is required. Furthermore, there is need for an automated, and thus cost-effective, assembling process for such a lighting device.

SUMMARY OF THE INVENTION

It is one object of the present invention to provide a lighting device that can be assembled with an automated method and has an improved protection against environmental influences, in particular water and/or dust. A further object of the present invention is to provide an LED module for such a lighting device, the LED module being protected against environmental influences. A further object of the present invention is to provide a method that can be automated for assembling a lighting device with an improved protection against environmental influences.

These objects are solved by a lighting device, an LED module, and a method for assembling a lighting device according to the independent claims. Preferred embodiments are given by the dependent claims, the specification, and the figures.

Accordingly, a lighting device is provided, comprising at least one LED module, which is connected to a retainer, and a driver that is electrically connected to the LED module. The driver is connected to the retainer via an adaptor board, wherein the adaptor board is positioned in between the driver and the retainer. Further, the driver is at least partially cast.

Due to the use of an adaptor board for connecting the driver and the retainer, it is possible to automate the assembly of the lighting device and to provide a compact and robust lighting device. By further exploiting a potting material that casts the driver, protection against environmental influences, such as water and/or dust, may be provided.

Preferably, the adaptor board is in direct contact with the driver and/or the retainer. It is possible for the adaptor board to be electrically conductively connected to the driver. For this, the driver may comprise a driver board with contacting means that are connected to the adaptor board. The adaptor board may be a printed circuit board with conductive tracks. In particular, the adaptor board and the conductive tracks may be formed such that an electrical contact is provided between the contacting means of the driver board and the conductive tracks of the adaptor board when the driver is connected to the retainer via the adaptor board.

In at least one embodiment of the lighting device, the LED module and the driver may be connected to opposite sides of the retainer. For example, the LED module is connected to a mounting side of the retainer and the driver is connected to a bottom side of the retainer, said bottom side facing away from the mounting side. Preferably, the at least one LED module is connected to the retainer in a form-fitting manner. A form-fitting connection may be a mechanically releasable connection that can be released without destroying the connecting components. For example, a plug-in connection is a form-fitting connection.

Preferably, the LED module is connected to the retainer such that a light emission surface of the LED module, i.e. a face through which light is emitted from the LED module, faces away from the retainer. The retainer may then be an inner part of the lighting device.

The retainer can be formed with an electrically insulating material, such as a plastics material. The retainer, for instance, comprises a disc and a middle pillar. The disc of the retainer may have a disc-like shape. The middle pillar may extend from a central part of the disc away from said disc. The shape of the retainer thus can be similar to a vacuum flange with an attached tube.

According to a preferred embodiment, the driver is sealed against environmental influences by the potting material. Hereinafter, a sealing or a seal of a component, such as for example the driver, may be a mechanical protection of said component from the environment. For example, the component may be waterproof and/or dust protected owing to the sealing. Furthermore, a sealing may provide protection from electrical flashover. For this, the used sealing means, for example the potting material, may consist of an electrically insulating material. At least parts of the driver may be in direct contact with and surrounded by the potting material.

In a preferred embodiment, the potting material is also at least partially in direct contact with the retainer. For example, the potting material may adjoin the disc of the retainer and/or may be filled into the middle pillar of the retainer. To allow for the potting material to adjoin the retainer, the potting material may protrude or extend through the adaptor board. For example, the potting material may protrude through further openings in the adaptor board.

According to at least one embodiment of the lighting device, the LED module comprises wirings. The wirings extend through at least one feed-through in the retainer and through the adaptor board and are soldered to the adaptor board. Here, the wirings may be connected to conductive tracks of the adaptor board by the solder. The use of solder enables assembling of the lighting device with an easy and reliable method.

The wirings may be electrically conductively connected to a lighting means of the LED module, such as for example a light-emitting diode of the LED module. Preferably, the LED module comprises at least two wirings, particularly preferable three wirings.

The at least one feed-through may be an opening in the disc of the retainer. In addition or as an alternative, the at least one feed-through may be an opening in the middle pillar of the retainer. For example, the wirings extend through the feed-through in the disc and/or the feed-through in the middle pillar of the retainer. Further, the adaptor board may comprise openings through which the wirings are fed.

According to at least one embodiment of the lighting device, the driver is housed by a housing into which the potting material is filled. The housing may have the shape of at least one truncated cone and/or a cylinder. For example, the housing is composed of several truncated cones and/or cylinders. For this, the housing may have a concave portion that encompasses the driver and the potting material. The housing may be of multipart construction. As an example, the housing comprises a first part with a concave portion for protecting the driver and a second part for electrically connecting the driver to a lamp socket. The first part may be formed with an electrically insulating material and the second part may be formed with a conductive material. For example, the second part is an Edison lamp base, such as, for instance, an Edison E27 or E40 lamp base. Since the potting material is filled into the housing, the potting material may take the shape of the housing. For example, during a method for providing the potting material, said material was filled into the concave portion of the housing and cured afterwards.

According to at least one embodiment of the lighting device, the at least one LED module is an LED side module and/or an LED top module. The lighting device may particularly comprise at least one LED side module and/or at least one LED top module. Preferably, the lighting device comprises a plurality of the LED side modules and a single LED top module. The LED side modules may be positioned onto the disc of the retainer. Further, the LED top module may be positioned onto the middle pillar of the retainer. The LED top module may cover at least one LED side module, preferably all LED side modules. For example, the LED side modules are positioned along a circle around the middle pillar. A main extension plane of each LED side module may run along a main extension direction of the middle pillar. The LED side modules may then follow a shell surface of a cylinder around the middle pillar.

According to a preferred embodiment, the lighting device satisfies IP code IP 65 according to IEC standard 60529. In addition, the LED module may also satisfy IP code IP 65. The IP code (International Protection Marking) according to IEC standard 60529 classifies and rates the degree of protection provided against dust and water by mechanical casings and electrical enclosures. The equivalent British standard is EN 60529. IP 65 may correspond to a NEMA enclosure rating (NEMA: National Electrical Manufacturers Association) of at least 4. The first digit of the IP Code refers to solid particle protection, whereas the second digit refers to liquid ingress protection. IP 65 refers to a dust tight solid particle protection (level sized 6) and a protection against water jets regarding the liquid ingress protection (level sized 5). Fulfilling IP 65 is, for example, required for lighting devices that are intended for use in a wet and/or dusty environment, such as lighting devices for wet rooms, e.g. bathrooms, or outdoor illumination.

Further, an LED module is provided. Preferably, the LED module is configured for being placed into a lighting device as described above. That is to say, all features that are disclosed in connection with the lighting device are also disclosed for the LED module and vice versa.

The LED module comprises at least one light-emitting diode, which is attached to a heat sink, and a cover with wirings. The cover is mechanically connected to the heat sink and covers the light-emitting diode. The cover and the heat sink may then enclose an inner part of the LED module, wherein the light-emitting diodes are positioned in said inner part. The wirings are electrically connected to the at least one light-emitting diode. Preferably, the LED module comprises a plurality of light-emitting diodes, wherein the wirings are connected to all light-emitting diodes of the LED module.

Since the LED module comprises a sealing member, the LED module is sealed against environmental influences. Owing to this seal, no further housing for sealing the LED module is required. This simplifies the assembly of a lighting device that comprises the LED module. Further, the life time of the light-emitting diodes may be enhanced since protection against environmental influences is improved due to the sealing member.

The cover may comprise a connector that contains the wirings. The connector may further comprise an opening in the cover through which the wirings extend from an inner part of the LED module to the outside. For example, the connector may be adapted for being connected to a feed-through of a retainer of a lighting device, such that the wirings extend from the inner part of the LED module through the connector and the feed-through and an adaptor board to the driver of the lighting device.

Preferably, the at least one light-emitting diode is heat-conductively connected to the heat sink. That is to say, heat produced during operation of the at least one light-emitting diode is guided to the heat sink. At least parts of the heat sink may frame the at least one light-emitting diode. For example, the heat sink comprises an indentation that has the at least one light-emitting diode.

The cover may consist of a light-transmitting material, such as a light-transmitting glass and/or a light-transmitting plastic. Hereinafter, "light-transmitting" means that at least 60%, preferably at least 80%, of the light emitted by the light-emitting diode and impinging on the cover is transmitted through the cover. The cover may be positioned at a top side of the light-emitting diode that faces away from the heat sink. Preferably, the cover faces a light-exit area of the light-emitting diode through which light emitted by the light-emitting diode exits the light-emitting diode. The cover may then be a light-emission window of the LED module through which light emitted by the at least one light-emitting diode leaves the LED module.

The heat sink and the cover may extend along a, preferably common, main extension plane. Perpendicular to the main extension plane, the cover and the heat sink may respectively have a thickness. The thickness of the cover and the heat sink may be small compared to the extension of the cover and the heat sink along the main extension plane, respectively. It is possible for the cover and the heat sink to have an identical or similar shape and size along the main extension plane. In this context, the heat sink and the cover have a similar size if the extension of the heat sink and the cover along the main extension plane differs by at most 10%, preferably at most 5%. For example, the heat sink may be rectangular; the cover may then also be rectangular, with the extension of the long side and the short side of the cover being at most +/−10% of the extension of the long side and the short side of the heat sink, respectively. Further, the heat sink may be disc-shaped; the cover may then also have a circular or disc-like shape, with the diameter of the cover being at most +/−10% of the diameter of the heat sink.

According to a preferred embodiment, the LED module further comprises a sealing member. The sealing member is positioned in between the cover and the heat sink. Further, the sealing member frames the at least one light-emitting diode. That is to say, in a top view onto the light-emitting diode, the sealing member surrounds the light-emitting diode in its entirety. Preferably, the light-emitting diode is sealed by, preferably only by, the sealing member, the cover, and the heat sink.

The sealing member may be in direct contact with the cover and the heat sink. For example, the sealing member provides a firm bond between the cover and the heat sink. Hereinafter, a firm bond is a bond that may only be released by destroying the bonding member, for example by using a solvent. For example, an adhesive bond is a firm bond. Additionally or alternatively, the heat sink and the cover may be connected by a mechanically releasable connection, for example by the use of terminals.

The sealing member may be positioned along an outer frame of the cover and/or the heat sink. The outer frame of the cover and/or the heat sink may respectively correspond to an outer rim of the cover and/or the heat sink. The outer frame may run parallel to the main extension plane. In the top view, the sealing member may take the shape of the cover and/or the heat sink. The light-emitting diode may be free of the sealing member. That is to say, the light-emitting diode is not in direct contact with the sealing member and the light-exit area of the light-emitting diode is not covered by the sealing member.

It is possible that the entire LED module is sealed by the sealing member, the cover, and the heat sink. The cover and the heat sink may then be an outer part of the LED module. In this regard, the LED module may still be seen as being sealed if there is an opening in the cover for the wiring to be fed through. This opening may, for example, be sealed with a further sealing member. The LED module may then be sealed in its entirety by the sealing member and the further sealing member, in connection with the cover and the heat sink.

According to at least one embodiment of the LED module, the light-emitting diode is mounted to a printed circuit board. The printed circuit board may be mounted on the heat sink. The printed circuit board and the cover both comprise a, in particular electrical, plug-in connector for providing the electrical connection between the wirings and the light-emitting diode. The two plug-in connectors may thus be electrically and mechanically connected to each other. Further, the wirings may be electrically conductively connected to the plug-in connector of the cover and the light-emitting diode may be electrically conductively connected to the plug-in connector of the printed circuit board. For this, the printed circuit board may comprise conductive tracks that are connected to the at least one light-emitting diode, preferably the plurality of light-emitting diodes.

Further, a method for assembling a lighting device is provided. Preferably, the above-described lighting-device and/or the above-described LED module may be assembled by use of the method. That is to say, all features disclosed in connection with the lighting device and/or the LED module are also disclosed for the method and vice versa.

In a first step ("step a)") of the method for assembling the lighting device, at least one LED module is connected to a retainer. In a second step ("step b)") of the method, a driver is connected to the retainer by use of an adaptor board that is positioned in between the driver and the retainer. In a third step ("step c)") of the method, the driver is inserted into a housing. Here, step c) is performed after steps a) and b). In other words, the driver is inserted into the housing after it has already been attached to the retainer.

Currently available methods, where the driver is positioned in the housing before the driver is connected to a retainer or an LED module, require complex connection means for connecting the driver and the retainer. In contrast to this, attaching the driver to the retainer before inserting the driver into the housing allows for an easy assembly of the lighting device.

According to a preferred embodiment of the method, the LED module comprises at least one light-emitting diode and wirings for electrically connecting the light-emitting diode to the driver. After the step of connecting the LED module to the retainer, i.e. after step a), the wirings protrude from a bottom side of the retainer that lies opposite to a mounting side of the retainer onto which the LED modules are mounted. In other words, the wirings are fed through the retainer. Preferably, the wirings are fed through the retainer by step a), that is to say, due to the connection of the LED module to the retainer.

According to at least one embodiment of the method, the method comprises the further step of soldering the wirings to the adaptor board. By this, an electrical connection between the LED module, in particular the light-emitting diode of the LED module, and the adaptor board may be provided. The soldering step is preferably performed after step a) and before step b), i.e. after the LED module has been connected to the retainer and before the driver is connected to the retainer. For facilitating the soldering, the wirings may also extend through the adaptor board. Soldering is a reliable, cost-effective and easy-manageable method for electrically connecting wirings to a printed circuit board.

According to at least one embodiment of the method, the method comprises the further step of filling the housing with a potting material such that the potting material is in direct contact with the retainer and such that the driver is cast by the potting material. Preferably, the filling step is performed after the driver has been positioned in the housing. After the potting material has been filled into the housing, the potting material may be cured, for instance by the use of thermal curing.

According to at least one embodiment of the method, the LED module is connected to the retainer in a form-fitting manner. For example, the LED module is connected to the retainer by the use of a plug-in connection. In particular, no additional connecting means, such as screws, adhesives or clamps, may be required for the connection of the LED module to the retainer. This allows for an even more cost-effective and reliable method for assembling the lighting device.

According to a preferred embodiment of the method, providing the LED module comprises the steps of attaching at least one light-emitting diode to a heat sink, mechanically connecting a cover to the heat sink, and electrically connecting wirings of the cover to the light-emitting diode. Here, the mechanical and the electrical connection are provided in a single step. That is to say, the cover is installed to the heat sink at the same time as the electrical connection is prepared. For example, the cover may comprise a plug-in connector that may be connected to a plug-in connector of the light-emitting diodes, in particular a printed circuit board of the light-emitting diodes.

According to at least one embodiment of the method, providing the LED module comprises the further step of positioning a sealing member in between the cover and the heat sink. This further step is performed before the mechanical connection between the cover and the heat sink is provided. The sealing member frames the at least one light-emitting diode.

BRIEF DESCRIPTION OF THE DRAWINGS

Preferred embodiments of the invention will be explained in the following, having regard to the drawings.

DETAILED DESCRIPTION OF THE INVENTION

Figure 1:
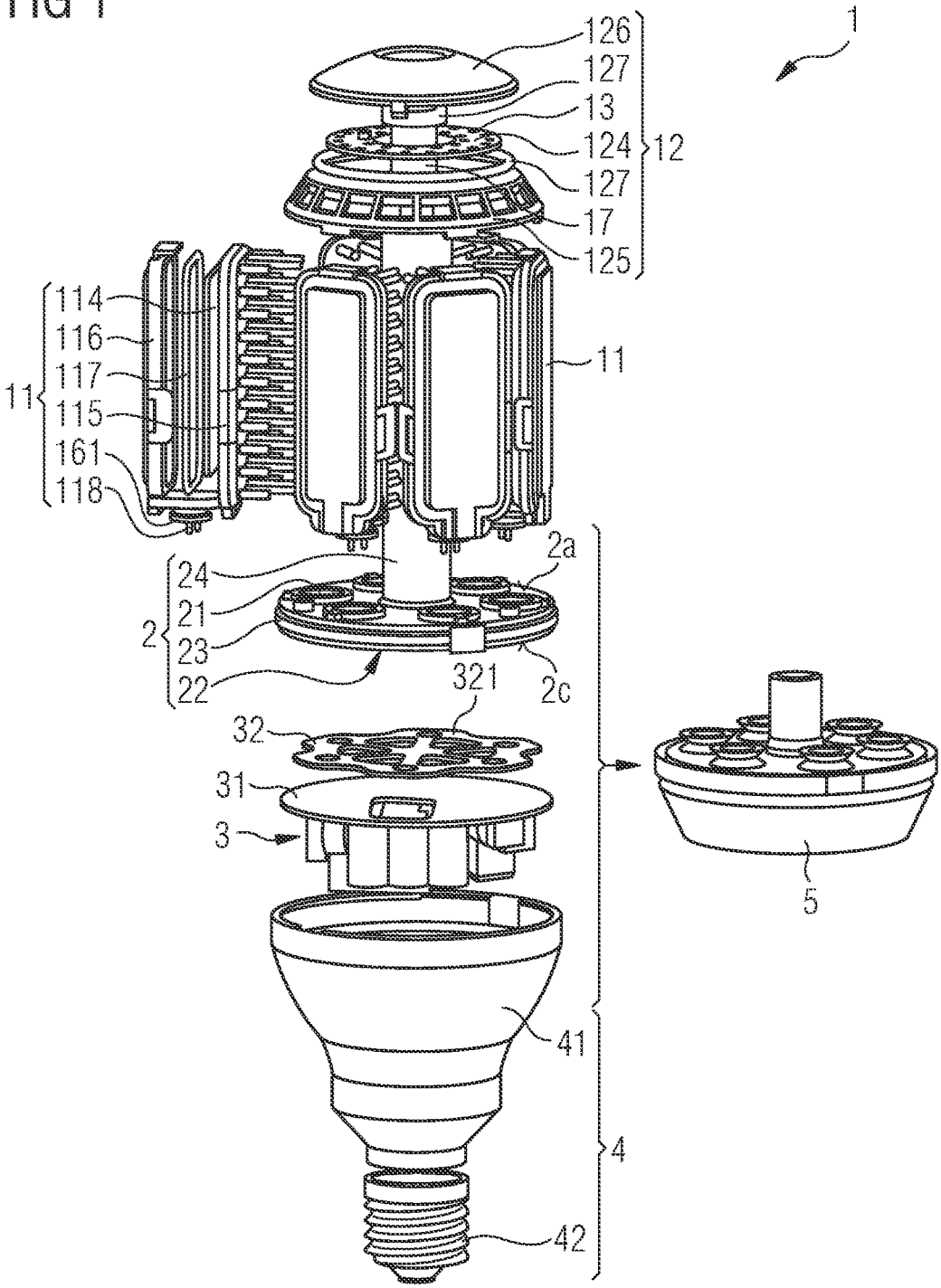
FIG. 1 shows an embodiment of a lighting device according to the present invention.

In the following, preferred embodiments of the invention will be described with reference to the drawings. Here, elements that are identical, similar or have an identical or similar effect are provided with the same reference numerals in the figures. The figures and the size relationships of the elements illustrated in the figures among one another should not be regarded as to scale. Rather, individual elements may be illustrated with an exaggerated size to enable better illustration and/or better understanding.

With reference to the blow-up drawing of FIG. 1, an embodiment of a lighting device 1 according to the present invention is described in detail. The lighting device 1 comprises an LED top module 12, a plurality of LED side modules 11, a retainer 2, an adaptor board 32, a driver 3, a potting material 5, and a housing 4.

Both the LED top module 12 and the LED side module 11 have a plurality of light-emitting diodes 13 that are mounted onto a printed circuit board 114, 124, a heat sink 115, 125, a cover 116, 126, a sealing member 117, 127, and wirings 118, 128 (not shown for the LED top module 12). The respective sealing member 117, 127 is positioned in between the respective cover 116, 126 and the respective heat sink 115, 125 of the LED top module 12 or the LED side module 11. For example, the sealing member 117, 127 is a seal ring, such as an O-ring. In addition, or as an alternative, the sealing member 117, 127 may be a sealing glue. The cover 116 of the LED side module 11 further comprises a connector 161 through which the wirings 118 of the LED side module 11 are fed.

The LED side modules 11 are mounted to a disc 23 of the retainer 2 such that the respective cover 116 of each LED side module 11 faces away from a middle pillar 24 of the retainer 2 and the heat sinks 115 of the LED side modules 11 face the middle pillar 24. Further, the heat sinks 115 of the LED side modules 11 face each other. The respective connector 161 of the LED side module 11 is connected to first feed-throughs 21 in the disc 23 of the retainer 2.

The LED top module 12 is mounted to the middle pillar 24 and covers all LED side modules 11 such that the main extension plane of the LED side modules 11 runs perpendicular to a main extension plane of the LED top module 12. The connection between the LED top module 12 and the middle pillar 24 is provided by use of a connection pillar 17 of the LED top module 12. The connection pillar 17 can be seen as a connector of the LED top module 12. For sealing the LED top module 12 in the area of the connection pillar 17, the LED top module 12 has an additional sealing member 127 at the connection pillar 17. Wirings 128 of the LED top module 12 are fed through a second feed-through 22 of the retainer 2 that is positioned in the middle pillar 24 (not shown in FIG. 1).

At a bottom side 2*c* of the retainer 2, which faces away from a mounting side 2*a* of the retainer 2 onto which the LED modules 11, 12 are mounted, an adaptor 32 board is connected to the retainer 2. The adaptor board 32 is positioned in between a driver board 31 of the driver 3 and the retainer 2. The adaptor board 32 comprises openings 321 for feeding through the wirings 118, 128 of the LED modules 11, 12. The adaptor board 32 has approximately the same diameter than the disc 23 of the retainer 2, thereby simplifying an assembling process. The driver 3 may comprise electronic components for providing a current to the light-emitting diodes 13 of the LED modules 11, 12. For example, the driver 3 comprises resistors, transistors and/or inductors for transforming a current and/or voltage supplied by a lamp socket for the lighting device 1 into an operating current and/or voltage for the LED modules 11, 12.

The driver 3 is housed by a housing 4. The housing 4 has a first housing part 41 and a second housing part 42. The first housing part 41 may be a hollow plastics component that is configured for enclosing the driver 3. The second housing part 42 may be formed electrically conductive for providing an operating current provided by a lamp socket to the lighting device 1. The second housing part 42 is electrically conductively connected to the driver 3.

The driver 3 is cast and sealed by a potting material 5. For ease of understanding, in FIG. 1 the potting material 5 is indicated on the side, next to the driver 3, the housing 4 and the retainer 2. The potting material 5 may comprise a silicone and/or an epoxy resin or may consist of such a material. The potting material 5 is also partly filled in the first feed-throughs 21 and the second feed-through 22 of the retainer 2, thereby also sealing the wirings 118, 128 of the LED modules 11, 12.

Figure 2A:
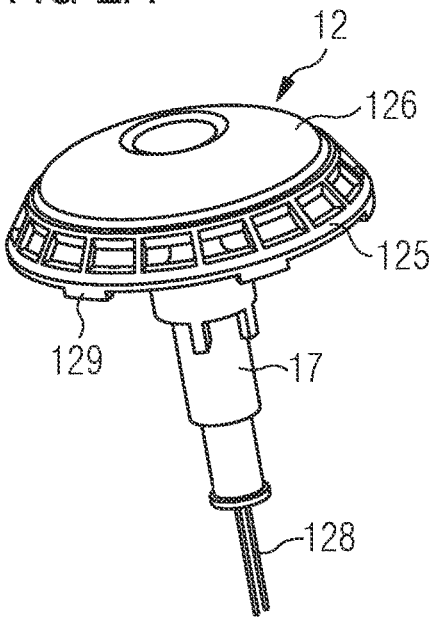
FIGS. 2A and 2B show embodiments of an LED module according to the present invention.
Figure 2B:
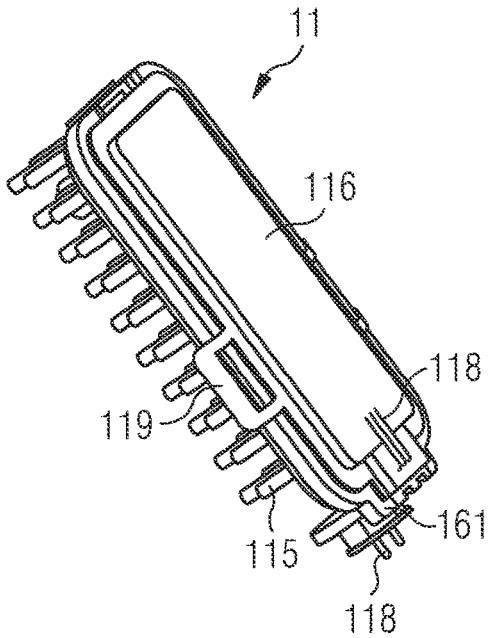

With reference to the schematic drawings of FIGS. 2A and 2B, embodiments of LED modules 11, 12 according to the present invention are explained in detail. FIG. 2A shows an embodiment of an LED top module 12 and FIG. 2B shows an embodiment of an LED side module 11.

The LED top module 12 and the LED side module 11 respectively have a cover 116, 126, a heat sink 115, 125, and wirings 118, 128. In the case of the LED top module 12, the wirings 128 are fed through a connection pillar 17 that protrudes from the heat sink 125 of the LED top module 12. The respective cover 116, 126 of the LED modules 11, 12 is connected to the respective heat sink 115, 125 by the use of terminals 119, 129. These terminals 119, 129 provide a mechanically removable bond between the cover 116, 126 and the heat sink 115, 125.

The cover 116 of the LED side module 11 has a connector 161 that is positioned at a side face of the cover 116. Wirings 118 of the light-emitting diode 13 (not shown in FIG. 2B) of the LED side module 11 pass through the connector 161 and thus can be electrically conductively connected from outside the LED side module 11. For example, the connector 161 may be plugged into a first feed-through 21 of a retainer 2 of a lighting device 1 such that the LED side module 11 is connected to the retainer 2 in a form-fitting manner and such that the wirings 118 pass through the first feed-through 21 of the retainer 2.

The connection pillar 17 of the LED top module 12 has the function of a connector of the LED top module 12. Here, the wirings 128 of the LED top module 12 pass through the connection pillar 17. The connection pillar 17 of the LED top module 12 may be inserted into a second feed-through 22 of a retainer 2 of a lighting device 1 such that the LED top module 12 is connected to the retainer 2 in a form-fitting manner and such that the wirings 128 pass through the second feed-through 21 of the retainer 2.

Figure 2C:
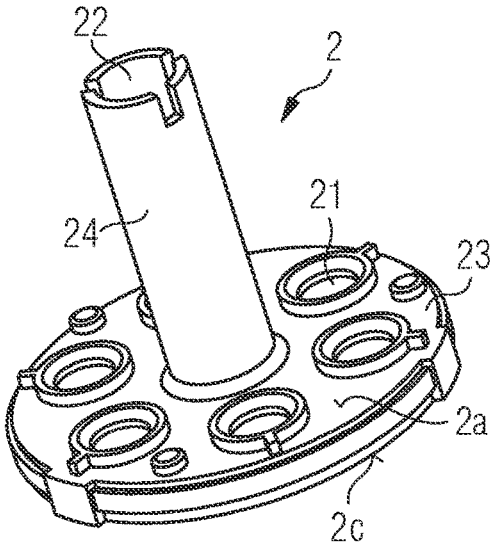
FIG. 2C shows an embodiment of a retainer for a lighting device according to the present invention.

With reference to the schematic drawing of FIG. 2C, an embodiment of a retainer 2 of a lighting device 1 according to the present invention is explained in detail. The retainer 2 has a shape similar to a vacuum flange with an attached tube. The retainer 2 comprises a disc 23 and a middle pillar 24 that protrudes from a center from the disc 23 and has a main extension axis that runs perpendicular to a main extension plane of the disc 23. The disc 23 comprises several first feed-throughs 21 through which wirings 118 may be fed and to which LED side modules 11 may be connected. The LED side modules 11 may then be connected to a mounting side 2*a* of the disc 23 and/or the retainer 2. Further, the middle pillar 24 has a second feed-through 22 through which wirings 128 may be fed and an LED top module 12 may be connected.

Figure 2D:
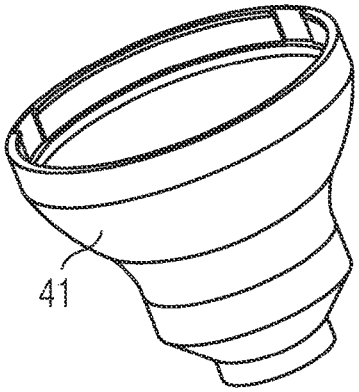
FIG. 2D shows an embodiment of a housing for a lighting device according to the present invention.

With reference to the schematic drawing of FIG. 2D, an embodiment of a first housing part 41 of a housing 4 of a lighting device 1 according to the present invention is explained in detail. The first housing part 41 is composed of a combination of cylindrical and truncated-cone like shapes. The housing 41 may be configured for receiving a driver 3 of a lighting device 1.

Figure 3A:
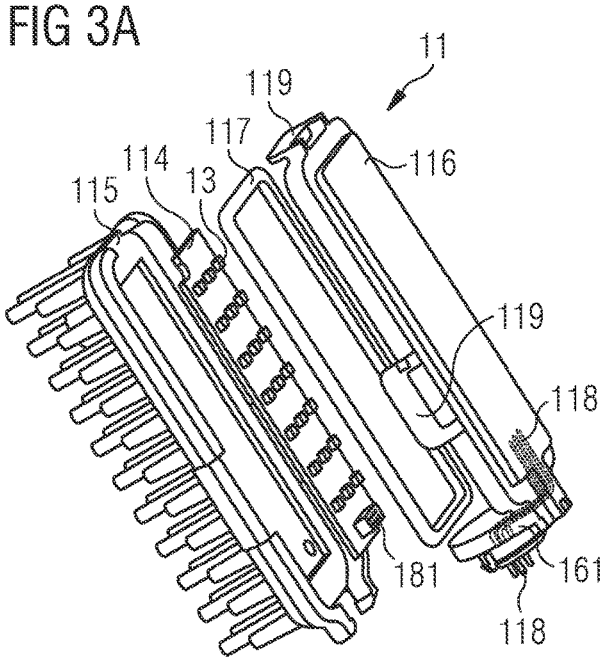
FIGS. 3A, 3B, 3C, 3D, 4A, 4B, 4C, 4D, 5A, 5B, 5C, 5D and 5E show embodiments of an LED module according to the present invention and embodiments for a method for assembling a lighting device and an LED module according to the present invention.
Figure 3B:
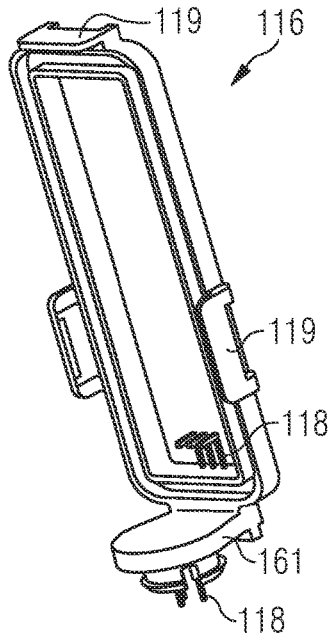
Figure 3C:
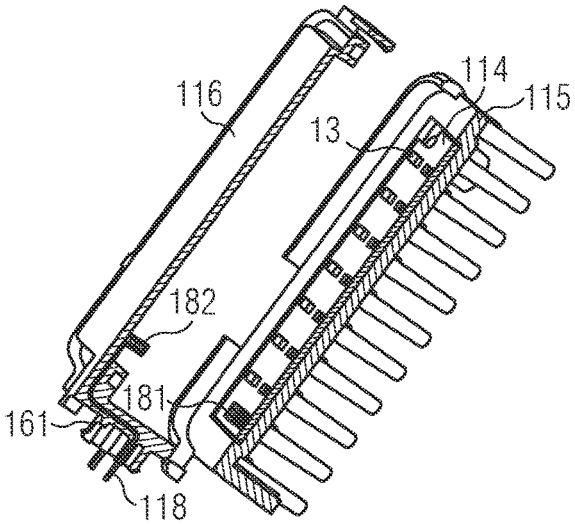
Figure 3D:
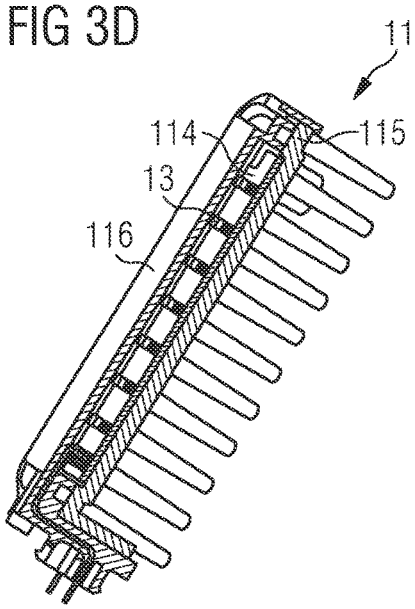

With reference to the schematic drawings of FIGS. 3A to 3D, embodiments of an LED side module 11 for a lighting device 1 and a method for assembling an LED side module 11 according to the present invention are explained in detail. For assembling the LED side module 11, a heat sink 115, a printed circuit board 114 with light-emitting diodes 13, a cover 116, and optionally a sealing member 117 are provided (see FIG. 3A). These components of the LED side module 11 are then mounted together. Here, a connection may be provided by terminals 119 of the cover 116 (see FIG. 3B). In addition, or as an alternative, the connection may be provided by the sealing member 117, for instance with an adhesive bond provided by the sealing member 117. Alternatively, the LED side module 11 may not comprise a sealing member 117 (FIGS. 3C and 3D).

Figure 4A:
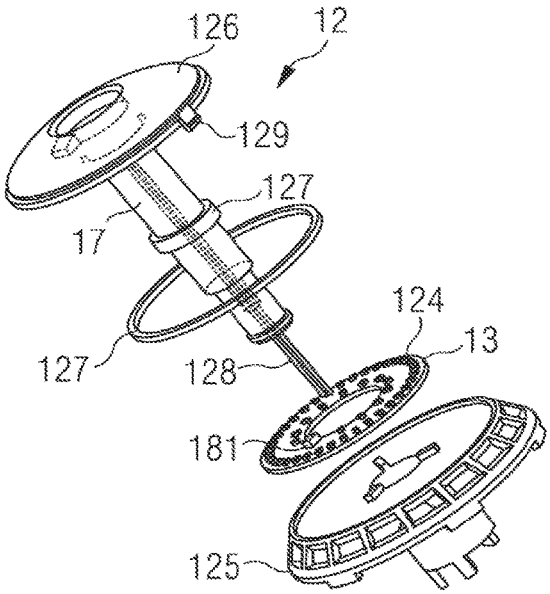
Figure 4B:
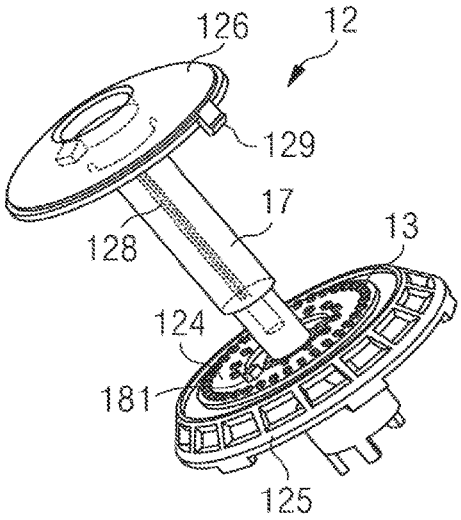
Figure 4C:
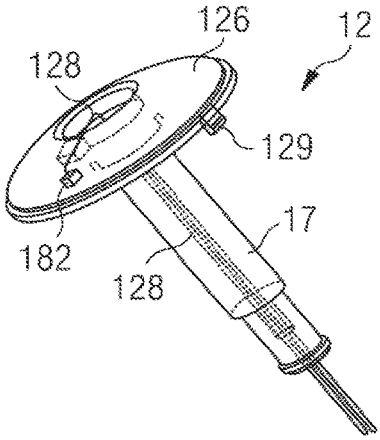
Figure 4D:
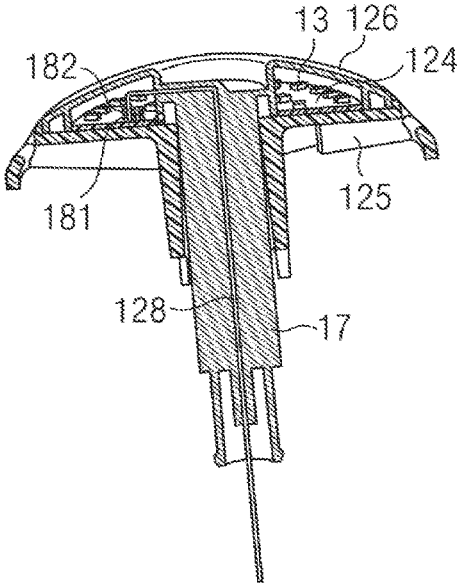

With reference to the schematic drawings of FIGS. 4A to 4D, embodiments of an LED top module 12 for a lighting device 1 and a method for assembling an LED top module 12 according to the present invention are explained in detail. As for the LED side module (see FIGS. 3A to 3D), for assembling the LED top module 12, a heat sink 125, a printed circuit board 124 with light-emitting diodes 13, and a cover 126 are provided (FIG. 4A). Optionally sealing members 127 may be provided that surround the connection pillar 17 of the LED top module 12. The components of the LED top module 12 are then mounted together. Again, a connection may be provided by terminals 129 of the cover 126 (FIG. 4C). In addition, or as an alternative, the connection may be provided by at least one of the sealing members 127 of the LED top module 12, for instance with an adhesive bond provided by the sealing member 127. Alternatively, the LED top module 12 may not comprise a sealing member 127 (FIGS. 4B and 4D).

Figure 5A:
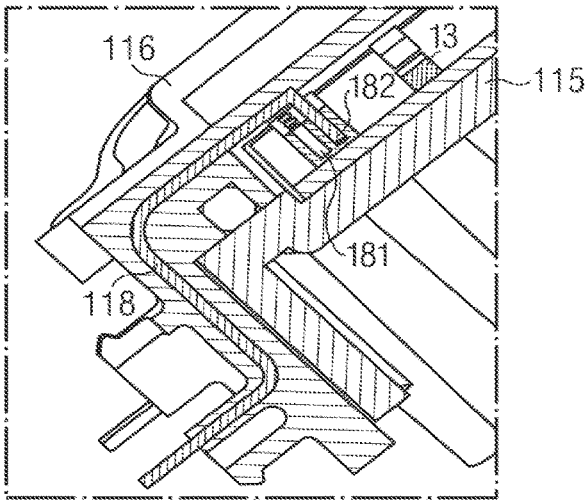
Figure 5B:
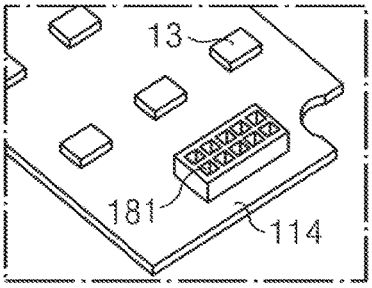
Figure 5C:
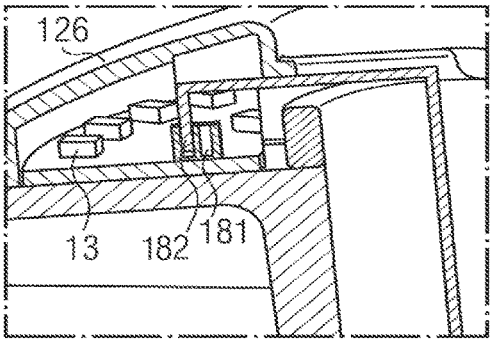
Figure 5D:
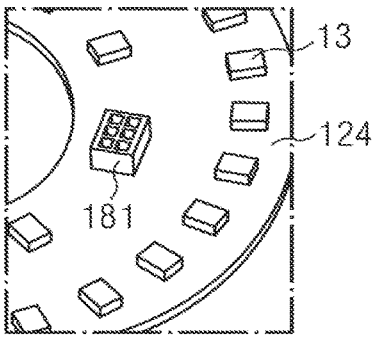
Figure 5E:
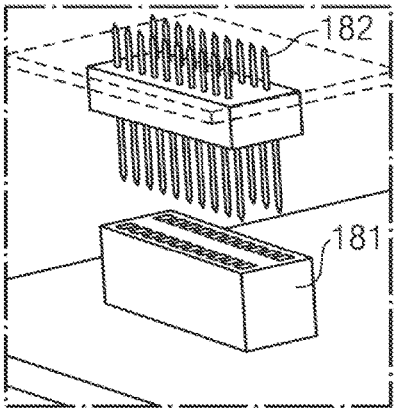

With reference to the schematic drawings of FIGS. 5A to 5E, establishing an electrical connection between the light-emitting diodes 13 and the respective wirings 118, 128 of the cover 116, 126 with regard to the embodiments of the LED modules 11, 12 of FIGS. 3A to 3D and 4A to 4D, is explained in detail. Here, FIGS. 5A and 5B show the connection for the LED side module 11 (see also FIGS. 3A to 3D) and FIGS. 5C and 5D show the connection for the LED top module 12 (see also FIGS. 4A to 4D). FIG. 5E shows the connection in general.

In addition to the light-emitting diodes 13, a plug-in connector 181 is mounted to the respective printed circuit board 114, 124 of the LED modules 11, 12. The plug-in connector 181 of the printed circuit board 114, 124 is electrically conductively connected to the light-emitting diodes 13, for example via a serial connection. The cover 116, 126 also comprises a plug-in connector 182. The plug-in connector 182 of the cover 116, 126 is electrically conductively connected to the wirings 118, 128 of the cover 116, 126.

When the cover 116, 126 is fixed to the heat sink 115, 125, the plug-in connectors 181, 182 are pushed together and an electrically conductive connection is established. For example, the plug-in connector 181 of the printed circuit board 114, 124 is a female plug-in connector and the plug-in connector 182 of the cover 116, 126 is a male plug-in connector (see FIG. 5E). The pins of a male plug-in connector may be connected to the sockets of a female plug-in connector by pushing the two connectors together. By the use of the plug-in connectors 181, 182, the electrical connection may be established at the same time as the mechanical connection.

With reference to the schematic drawings of FIGS. 6A to 6L, an embodiment of a method for assembling a lighting device 1 according to the present invention is explained in detail.

Figure 6A:
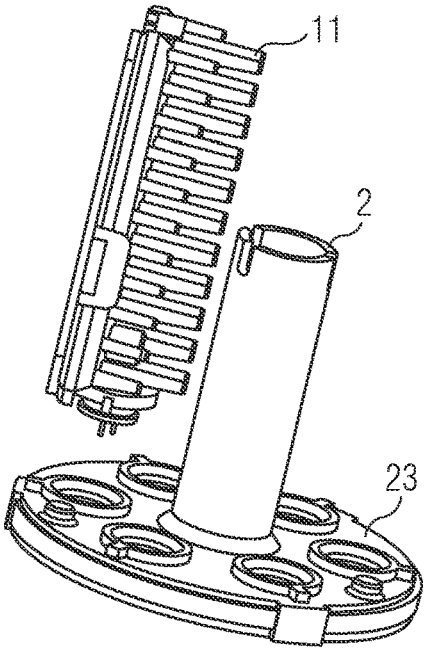
FIGS. 6A, 6B, 6C, 6D, 6E, 6F, 6G, 6H, 6I, 6J, 6K and 6L show an embodiment of a method for assembling a lighting device according to the present invention.
Figure 6B:
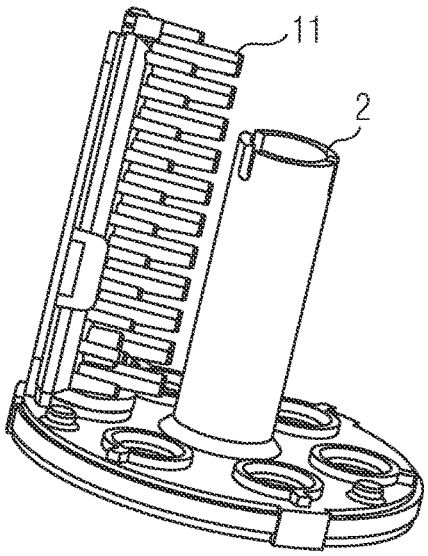
Figure 6C:
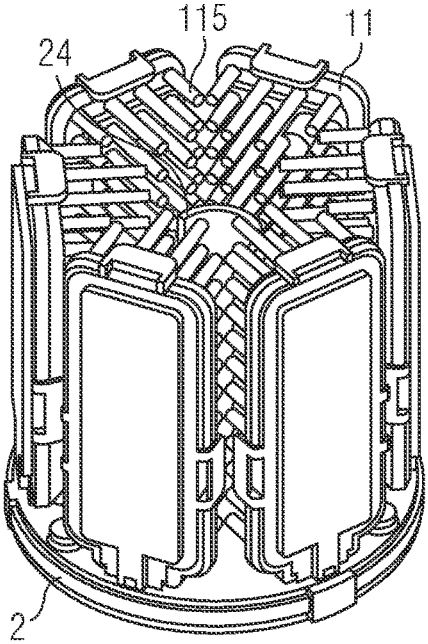
Figure 6D:
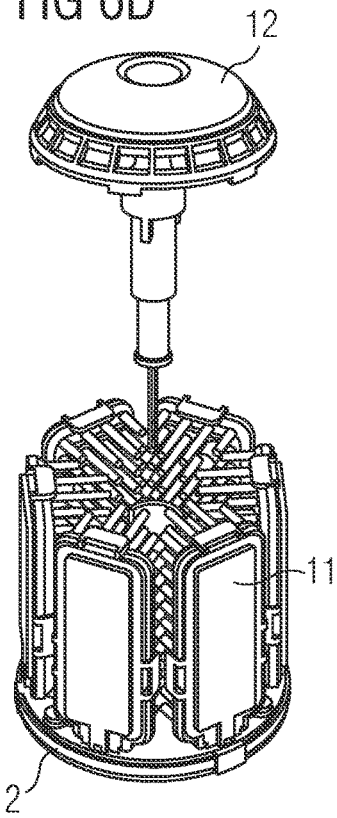
Figure 6E:
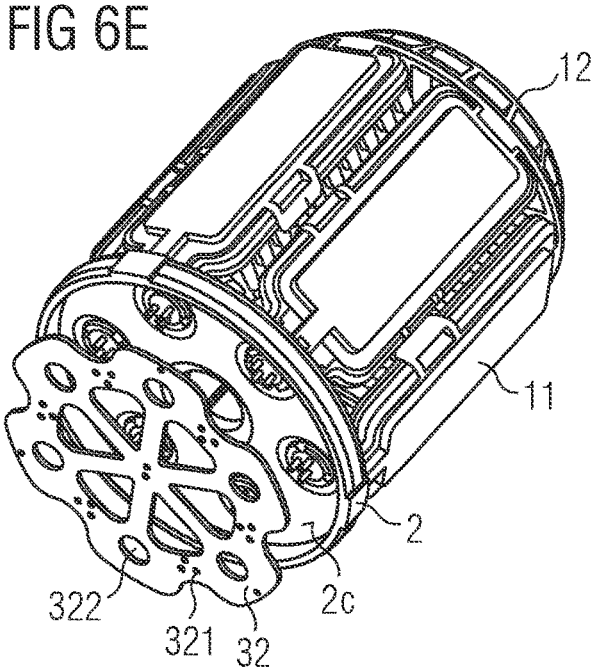
Figure 6F:
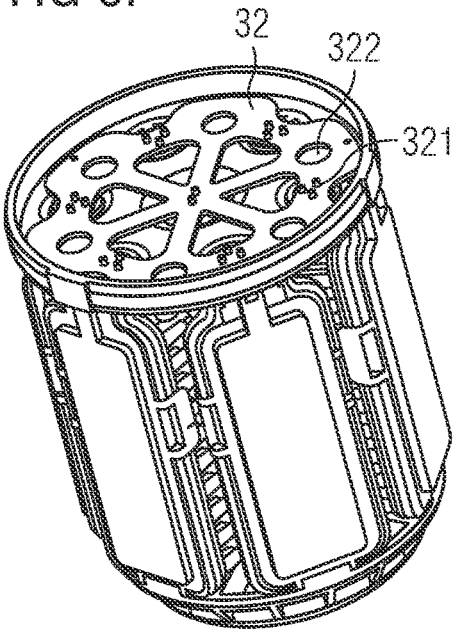

In a first step (FIGS. 6A, 6B, 6C), LED side modules 11 and a retainer 2 are provided and the LED side modules 11 are fixed to the disc 23 of the retainer 2 such that the respective heat sinks 115 of the LED side modules 11 face the middle pillar 24 of the retainer 2 (FIG. 6C).

In a second step (FIG. 6D), an LED top module 12 is connected to the middle pillar 24 of the retainer 2. The LED top module 12 then covers the LED side modules 11. After this step, the respective light-exit areas of the LED side modules 11 and the LED top module 12 face away from the middle pillar 24 of the retainer 2.

Figure 6G:
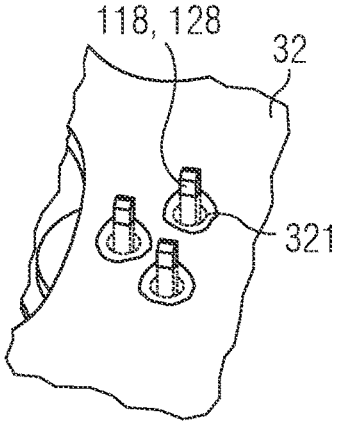
Figure 6H:
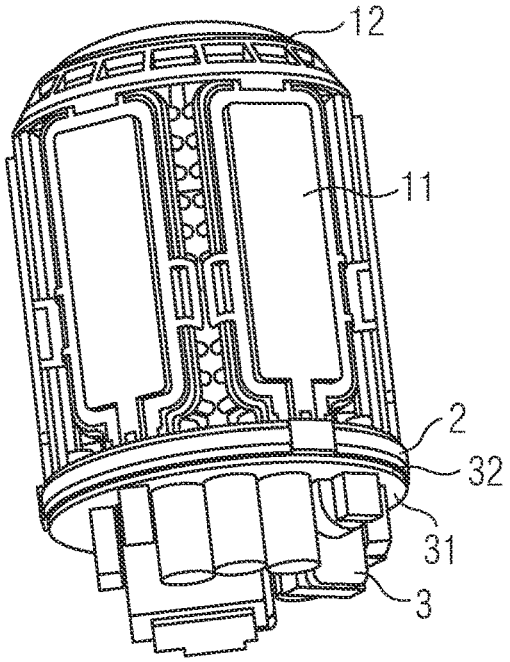
Figure 6I:
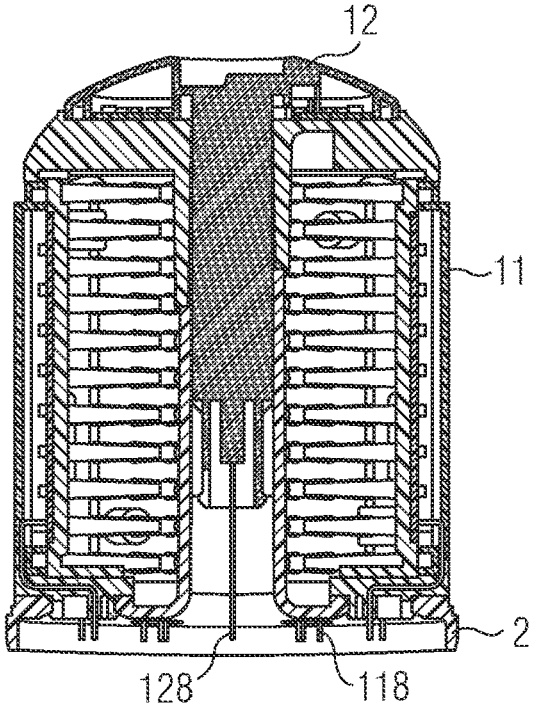

In a third step (FIGS. 6E, 6F, 6G), an adaptor board 32 is connected to a bottom side 2*c* of the retainer 2 that faces away from the LED modules 11, 12. The adaptor board 32 comprises openings 321 through which the wirings 118, 128 of the LED modules 11, 12 can be fed. The adaptor board 32 may also comprise further openings 322 for allowing a connection of the adaptor board 32 with the retainer 2 and for simplifying the casting with a potting material 5. In particular, some of the further openings 322 are positioned near the center of the adaptor board, thus letting a potting material 5 pass through to the adaptor board 32 and into the middle pillar 24 of the retainer 2. As can be seen in the zoom of FIG. 6G, the wirings 118, 128 protrude through the openings 321 in the adaptor board 32. The wirings 118, 128 are soldered to the adaptor board 32.

In a fourth step (FIGS. 6H, 6I), a driver 3 is connected to the adaptor board 32 via a driver board 31. The connection is provided such that the wirings 118, 128 of the LED modules 11, 12 that protrude through the retainer 2 and the adaptor board 32 are electrically conductively connected with the driver 3 (see also FIG. 6I).

Figure 6L:
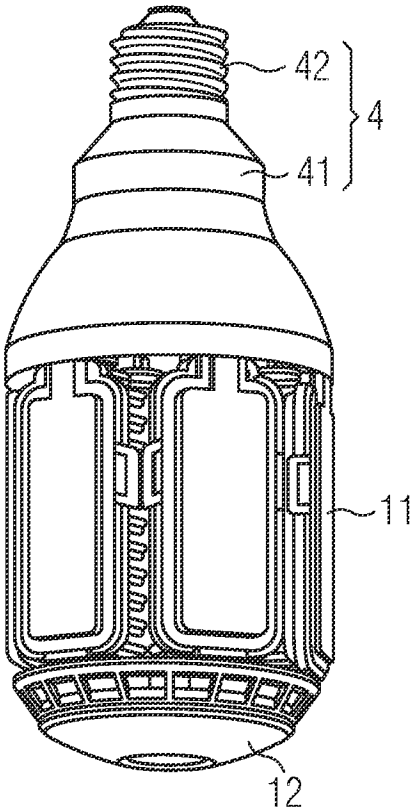
Figure 6K:
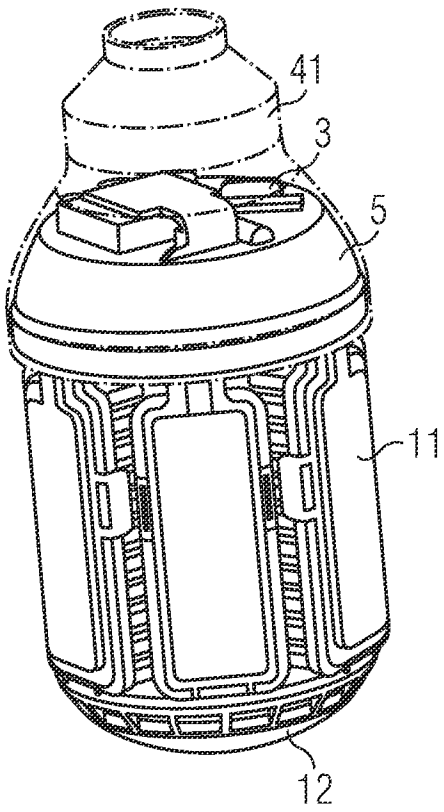
Figure 6J:
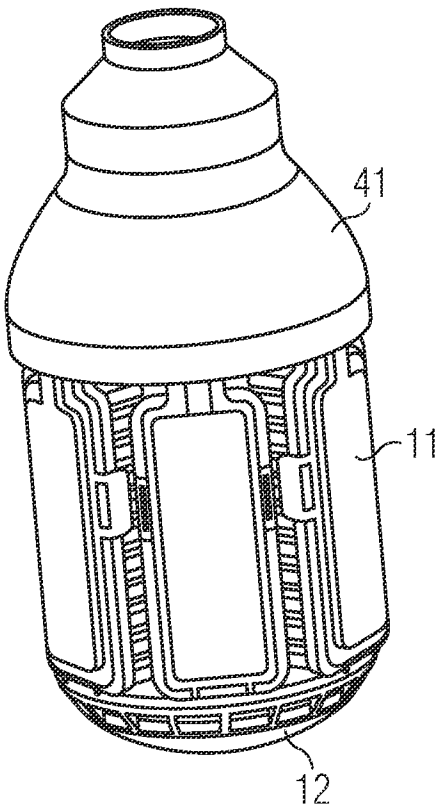

Afterwards, a first housing part 41 of a housing 4 is installed to the retainer 2 (FIG. 6J) and the housing 4 is filled with a potting material 5 (FIG. 6K) such that the potting material 5 casts the driver 3 at least in places, i.e. at least partially. Finally, as shown in FIG. 6L, a second housing part 42 of the housing 4 that allows for allows for an electrical and mechanical connection to a lamp socket is installed to the first housing part 41.

The invention is not restricted by the description based on the embodiments. Rather, the invention comprises any new feature and also any combination of features, including in particular any combination of features in the patent claims, even if this feature or this combination itself is not explicitly specified in the patent claims or exemplary embodiments.

LIST OF REFERENCE NUMERALS

1 Lighting device
11 LED side module
114 Printed circuit board of the LED side module
115 Heat sink of the LED side module
116 Cover of the LED side module
161 Connector of the cover
117 Sealing member of the LED side module
118 Wirings of the LED side module
119 Terminal of the LED side module
12 LED top module
124 Printed circuit board of the LED top module
125 Heat sink of the LED top module
126 Cover of the LED top module
127 Sealing member of the LED top module
128 Wirings of the LED top module
129 Terminal of the LED top module
13 Light-emitting diode
17 Connection pillar
181 Plug-in connector of the printed circuit board
182 Plug-in connector of the cover
2 Retainer
2*a* Mounting side
2*c* Bottom side
21 First feed-through of the retainer
22 Second feed-through of the retainer
23 Disc of the retainer
24 Middle pillar of the retainer
3 Driver
31 Driver board
32 Adaptor board
321 Openings in the adaptor board
321 Further openings in the adaptor board
4 Housing
41 First part of the housing
42 Second part of the housing
5 Potting material

The invention claimed is:

1. A lighting device comprising:
at least one light-emitting diode (LED module, which is connected to a retainer; and
a driver that is electrically connected to the LED module;
wherein the driver is at least partially cast by a potting material; and
wherein the driver is connected to the retainer via an adaptor board that is positioned in between the driver and the retainer.

2. The lighting device according to claim 1, wherein the LED module comprises wirings that extend through at least one feed-through in the retainer and through the adaptor board and are soldered to the adaptor board.

3. The lighting device according to claim 1, wherein the driver is housed by a housing into which the potting material is filled.

4. The lighting device according to claim 1, wherein the at least one LED module is configured as at least one of an LED side module and an LED top module.

5. The lighting device according to claim 1, wherein the lighting device satisfies IP Code IP 65 according to IEC standard 60529.

6. An LED module for the lighting device according to claim 1, the LED module comprising:
at least one light-emitting diode, which is attached to a heat sink; and
a cover with wirings;
wherein the cover is mechanically connected to the heat sink and covers the at least one light-emitting diode; and
wherein the wirings are electrically connected to the at least one light-emitting diode.

7. The LED module according to claim 6, wherein the LED module further comprises a sealing member that is positioned in between the cover and the heat sink and frames the at least one light-emitting diode.

8. The LED module according to claim 6, wherein the at least one light-emitting diode is mounted to a printed circuit board, and wherein both the printed circuit board and the cover comprise a plug-in connector for providing the electrical connection between the wirings and the at least one light-emitting diode.

9. The lighting device according to claim 1, wherein the potting material at least partially protrudes through the adaptor board.

10. The lighting device according to claim 1, wherein:
the retainer comprises a disc-like base portion and a pillar portion extending therefrom; and
the potting material at least one of:
adjoins the disc-like base portion; and
at least partially fills into the pillar portion.

11. The lighting device according to claim 1, wherein:
the retainer comprises a disc-like base portion and a pillar portion extending therefrom; and
the potting material:
adjoins the disc-like base portion; and
at least partially fills into the pillar portion.

12. The lighting device according to claim 1, wherein at least a portion of the driver is in direct contact with the potting material.

13. The lighting device according to claim 1, further comprising a housing, wherein the potting material at least partially fills the housing in at least partially casting the driver.

14. A method for assembling a lighting device, the method comprising:
connecting at least one light-emitting diode (LED) module to a retainer;
connecting a driver to the retainer via an adaptor board that is positioned in between the driver and the retainer; and
inserting the driver into a housing, wherein the inserting of the driver is performed after the connecting of the at least one LED module and the connecting of the driver; and
at least partially filling the housing with a potting material such that the driver is at least partly cast by the potting material.

15. The method according to claim 14, wherein the at least one LED module comprises at least one light-emitting diode and wirings for electrically connecting the at least one light-emitting diode to the driver, and wherein after the connecting of the at least one LED module, the wirings protrude from a bottom side of the retainer that lies opposite to a mounting side of the retainer onto which the at least one LED module is mounted.

16. The method according to claim 14, further comprising:

soldering the wirings to the adaptor board.

17. The method according to claim 14, wherein the potting material is in direct contact with the retainer.

18. The method according to claim 14, wherein the at least one LED module is connected to the retainer in a form-fitting manner.

19. The method according to claim 14, further comprising:

providing the at least one LED module by:

attaching at least one light-emitting diode to a heat sink;

mechanically connecting a cover to the heat sink; and electrically connecting wirings of the cover to the at least one light-emitting diode;

wherein the mechanical and the electrical connection are provided in a single step.

20. The method according to claim 19, wherein before mechanically connecting the cover, the method further comprises:

positioning a sealing member in between the cover and the heat sink, said sealing member framing the at least one light-emitting diode.

* * * * *